United States Patent [19]

Henne et al.

[11] Patent Number: 4,927,086

[45] Date of Patent: May 22, 1990

[54] GRINDING PROCESS AND APPARATUS

[75] Inventors: Heinrich Henne, Ennigerloh; Karl-Heinz Dammertz, Oelde; Lutz T. Schneider, Ennigerloh; Gotthard Blasczyk, Beckum, all of Fed. Rep. of Germany

[73] Assignee: Krupp Polysius AG, Fed. Rep. of Germany

[21] Appl. No.: 733,945

[22] Filed: May 14, 1985

[30] Foreign Application Priority Data

May 16, 1984 [DE] Fed. Rep. of Germany ..... 3418197

[51] Int. Cl.[5] ..... B02C 15/00

[52] U.S. Cl. ..... 241/80; 241/119

[58] Field of Search ..... 241/19, 24, 117–121, 241/80, 97, 52, 58, 79.1

[56] References Cited

U.S. PATENT DOCUMENTS

| | | | |
|---|---|---|---|
| 1,523,881 | 1/1925 | Kreutzberg | 241/58 |
| 3,491,954 | 1/1970 | Miller | 241/52 X |
| 3,951,347 | 4/1976 | Tiggesbaumker et al. | 241/119 X |
| 4,240,586 | 12/1980 | Evans | 241/119 X |

*Primary Examiner*—Mark Rosenbaum

*Attorney, Agent, or Firm*—Learman & McCulloch

[57] ABSTRACT

The invention relates to a grinding process and apparatus for the simultaneous production of at least two finished products of differing fineness using a ring mill. Pre-classification is carried out in the nozzle ring by adjusting the air to entrain and carry upwards relatively fine constituents. The coarser constituents are discharged downwardly by gravity and subsequently may be conveyed upwards by an elevator and subjected to a second classification in which at least a proportion is extracted as finished product.

8 Claims, 4 Drawing Sheets

GRINDING PROCESS AND APPARATUS

The invention relates to a grinding process and apparatus for producing simultaneously two products of different fineness.

BACKGROUND OF THE INVENTION

Ring mills in the form of roller mills or ball ring mills are well known. In these mills the grinding balls or rollers roll on a circular grinding plate, and the grinding pressure is produced by spring tension, hydraulic cylinders, centrifugal force, or by the weight of the balls or rollers.

In mills of this type a stationary nozzle ring mounted on the outer periphery of the grinding plate delivers an air stream which picks up the fine constituents of the comminuted material discharged over the edge of the grinding plate and carries them upwards, while the coarse constituents fall downward through the nozzle ring against the stream of air and are returned to the mill by means of a mechanical elevator for example.

In the past ring mills of this type were only used for the production of a relatively fine-grained finished product. This finished product was discharged from the mill with the air stream and separated off in separators (such as cyclones or filters).

There is now an occasional requirement in the art to produce finished products of differing fineness. For instance, in the production of aggregates a fine product, such as filler (with a grain size less than 0.2 mm), and a coarse product, such as an addition to masonry cement (with a grain size of 0 to 4 mm) may be required. In the past such finished products of differing fineness generally were produced in separate grinding apparatus, which involves a considerable expenditure on plant.

The object of the invention, therefore, is to provide grinding apparatus and a process which enables at least two finished products of differing fineness to be produced simultaneously in a simple and economical manner.

SUMMARY OF THE INVENTION

In the process according to the invention a single ring mill (roller mill or ball ring mill) is used to produce at least two finished products of differing fineness simultaneously, for example, a fine finished product with a range of grain sizes between 0 and 100 microns and a coarse finished product with a range of grain sizes from 0.1 to 2 mm. For this purpose the quantity of air and the air speed in the nozzle ring are adjusted so that a preclassification (presifting) takes place in the nozzle ring and the coarse constituents in a defined quantity and a specific gradation of grain sizes fall out downward through the nozzle ring.

In contrast to the usual manner of operating roller mills (with air speeds in the nozzle ring between 70 and 100 m/s), the grinding process according to the invention uses substantially lower air speeds (of the order of magnitude between 30 and 60 m/s) which, together with the specific air quantity set in the nozzle ring, leads to the precipitation of the coarse constituents in a defined quantity and gradation of grain sizes. The flow conditions in the nozzle ring are essentially selected so that the coarse constituents of the material for grinding falling downward through the nozzle ring contain a very small proportion of fines.

The coarse constituents of the material being ground, and which are precipitated through the nozzle ring and conveyed upwards by means of an elevator, are subjected in the grinding process to a second classification (screening or sifting) in which at least a proportion of the coarse constituents is extracted as a further finished product and the remaining proportion containing the coarsest constituents are returned to the mill.

THE DRAWING

An embodiment of the invention is disclosed in the accompanying drawings, in which.

DETAILED DESCRIPTION

Figure 1:
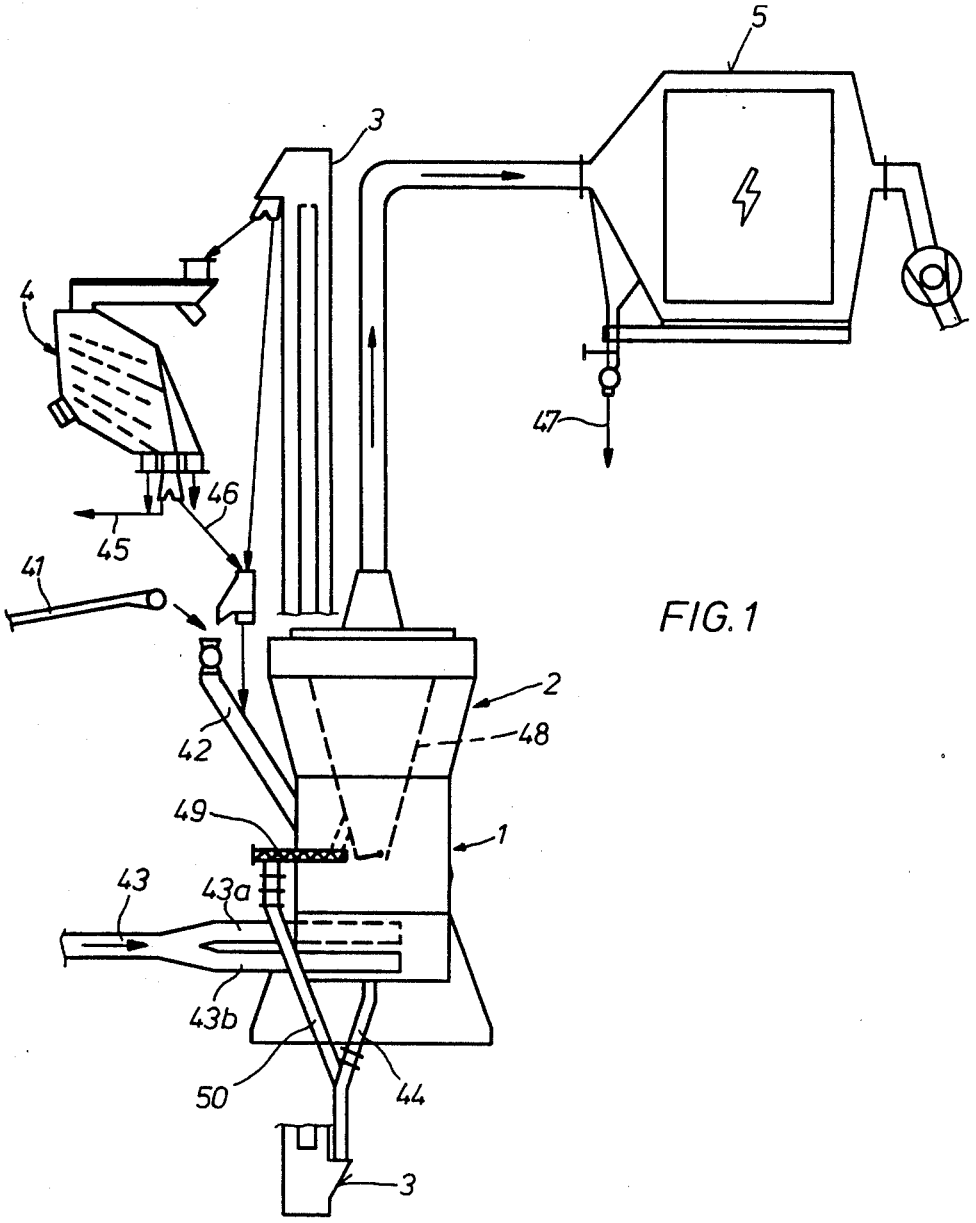
FIG. 1 is a schematic illustration of apparatus for carrying out the grinding process according to the invention.

The grinding apparatus shown in FIG. 1 comprises a roller mill 1 with a static sifter 2 arranged above it, a bucket conveyor 3, a screening apparatus 4, and an electrostatic filter 5.

Insofar as details of the roller mill 1 are essential for understanding the invention, these will be explained in greater detail with the aid of FIGS. 2 and 3.

Figure 2:
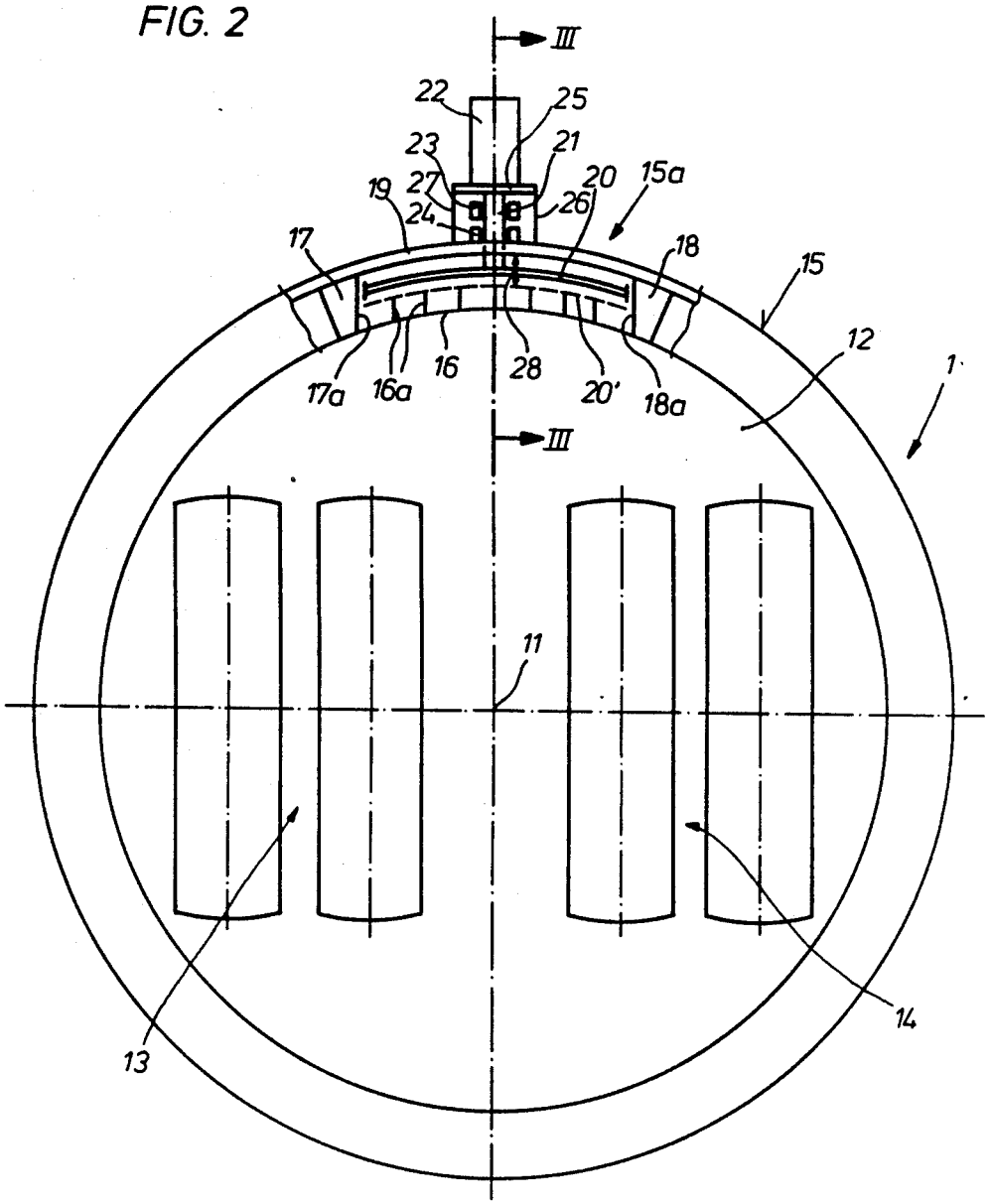
FIG. 2 is a plan view of the grinding plate and the nozzle ring of the roller mill according to FIG. 1.

The roller mill 1 shown schematically in FIGS. 1 and 2 includes a circular grinding plate 12 which rotates about a vertical axis 11 and on which two pairs of rollers 13, 14 roll.

A stationary nozzle ring 15 is mounted at the outer periphery of the grinding plate 12 and serves to supply an air stream (see arrow 38 in FIG. 3) which entrains the fine constituents of the comminuted material discharged over the edge of the grinding plate 12 and carries them upwards (arrow 39), while the coarse constituents of the material fall downward (arrow 40) through the nozzle ring 15 in counter flow to the air stream.

The nozzle ring 15 is divided into a plurality of like segments, of which the segment 15*a* is shown in detail in FIG. 2.

The segment 15*a* of the nozzle ring 15 comprises an inner stationary wall part 16 which is connected to the housing 19 of the roller mill 1 by two lateral guide parts 17, 18. The stationary inner wall part 16 supports a plurality of crosspieces 16*a* which are directed outwards.

The segment 15*a* of the nozzle ring 15 also includes an outer adjustable wall part 20 which is connected to the thrust spindle 21 of a pneumatic cylinder 22. The thrust spindle 21 is radially guided in sliding guides 23, 24. The pneumatic cylinder 22 is supported by a flange 25 which is mounted by means of struts 26, 27 on the housing 19.

The outer wall part 20 of the segment 15*a* of the nozzle ring 15 can be adjusted radially, as indicated by the two headed arrow 28, by means of the spindle 21 of the pneumatic cylinder 22 between a radially outer position in which the wall part 20 is located near the housing 19 and a radially inner position 20' shown by broken lines in which the adjustable wall part 20 touches the struts 16*a* of the stationary inner wall part 16 and in which it causes the internal cross-section of the interior 29 of the segment 15*a* through which air flows to be limited to a minimum.

The adjustable wall part 20 of the segment 15*a* is guided in the region of the ends facing the adjacent segments on parallel guide surfaces 17*a*, 18*a* of the guide parts 17, 18. In addition, a connecting link guide can be provided in the region of these guide surfaces 17*a*, 18*a* in order to exclude the danger of tilting of the adjustable outer wall part 20 relative to a horizontal plane.

As can be seen from FIG. 1, fresh material to be ground is delivered to the roller mill 1 by a conveyor belt 41 and a chute 42.

The air is supplied to the roller mill 1 through a duct 43 connected to a suitable hot air source and divided into branch ducts 43*a*, 43*b*.

The coarse constituents of the material to be ground and precipitated through the nozzle ring 15 pass through a duct 44 to the bucket conveyor 3 and are delivered by the latter to the screening apparatus 4. At least a proportion (for example the grit with a range of grain sizes between 0 and 4 mm) obtained in the screening apparatus 4 during the second classification of the coarse constituents is extracted as finished product (arrow 45), while the remaining proportion (arrow 46) containing the coarsest constituents is returned to the mill 1.

The fine constituents which are pneumatically discharged from the mill 1 in the upwards direction by the air stream are subjected to sifting in the static sifter 2 The fine constituents leaving the sifter 2 with the air stream are separated off (arrow 47) as a further finished product in the electrostatic filter 5.

The grit separated off in the sifter 2 can be returned in the conventional manner via the separating hopper 48 to the grinding plate 12 of the roller mill 1. However, a selected proportion of the grit separated off in the sifter 2 can be extracted by a discharge apparatus 49 (for example a screw conveyor) connected to the separating hopper 48 and also delivered via a duct 50 to the bucket conveyor 3. Instead of this, however, it is also possible to extract a proportion of the grit obtained as a result of the sifting in the sifter 2 as a further finished product.

Figure 5:
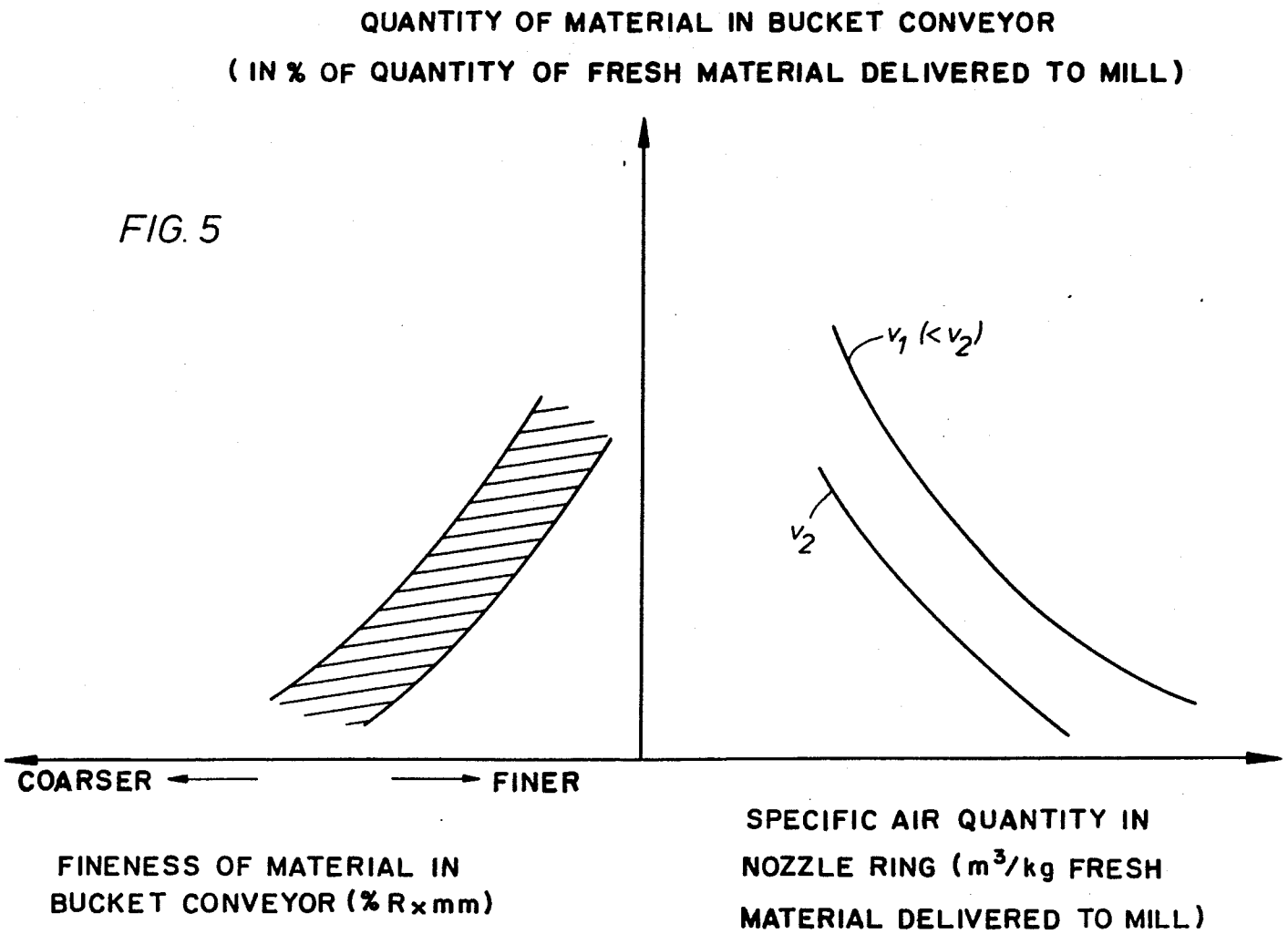
FIG. 5 is a diagram explanatory of the grinding process according to the invention.

The diagram of FIG. 5 is explanatory of the connection between the flow conditions in the nozzle ring and the quantity and fineness of the material falling downwards through the nozzle ring and carried upwards by the bucket conveyor.

The quantity of material in the bucket conveyor 3 (expressed as a percentage of the quantity of fresh material delivered to the mill) is plotted in the ordinate in the diagram of FIG. 5. The specific air quantity in the nozzle ring (expressed in $m^3$/kg fresh material delivered to the mill) is plotted in the abscissa in the right-hand part of the diagram. The abscissa in the left-hand part of the diagram of FIG. 5 corresponds to the fineness of the material in the bucket conveyor (expressed as a percentage residue (R) on a screen with x mm mesh size). Towards the left the material is coarser, and towards the right the material is finer.

The two curves in the right-hand part of the diagram show the conditions for two different air speeds $V_1$ and $V_2$ in the nozzle ring (in which $V_1 < V_2$). It will be recognized that as the specific air quantity in the nozzle ring increases the quantity of material in the bucket conveyor is reduced. If the specific air quantity remains the same and the air speed in the nozzle ring increases, then the quantity of material in the bucket conveyor is also reduced.

The family of characteristic curves in the left-hand part of the diagram is coordinated with the two curves in the right-hand part of the diagram. Thus by altering the air speed in the nozzle ring and the specific air quantity, differing quantities of material can be obtained in the bucket conveyor (quantity passing through the nozzle ring) with differing grain size spectrum.

For example, the following conditions could be produced:

| Specific air quantity in the nozzle ring ($m^3$/kg fresh material delivered to the mill) | Air speed in the nozzle ring (m/s) | % residue on screen of 1 mm mesh size | Quantity of material in the bucket conveyor (in % of the quantity of fresh material delivered to the mill) |
|---|---|---|---|
| | Example 1 | | |
| 0.9 | 40.0 | 48.0 | 75 |
| | Example 2 | | |
| 1.5 | 40.4 | 54.0 | 30 |
| | Example 3 | | |
| 1.1 | 49.0 | 43.0 | 30 |

Whereas the air speed prevailing in the nozzle ring is influenced primarily by adjustment of the outer wall parts 20 of the nozzle ring, the quantity of air delivered to the nozzle ring can be influenced for example by adjusting a conveyor blower and/or by adjusting valves provided in the air supplies to the nozzle ring.

Figure 3:
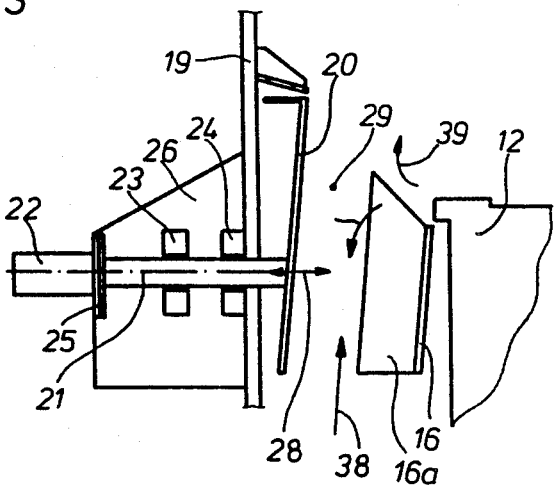
FIG. 3 is a section taken on the line III—III of FIG. 2.
Figure 4:
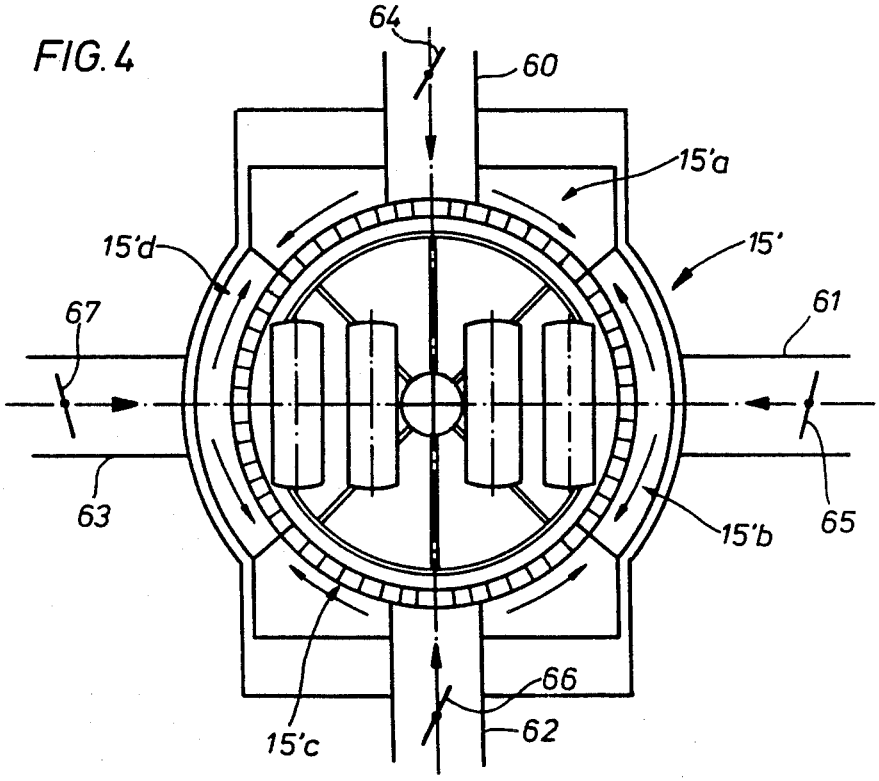
FIG. 4 is a schematic plan view of a variant of the roller mill shown in FIG. 1.

FIG. 4 shows in schematic form an embodiment in which four air supplies 60, 61, 62, 63 are provided with which separate adjustable segments 15'*a*, 15'*b*, 15'*c*, and 15'*d* of a nozzle ring 15' are associated. These four segments of the nozzle ring 15', details of which are not shown in FIG. 4, have (like the embodiment already described with the aid of FIGS. 2 and 3) a wall which can be adjusted from outside during operation to limit the internal cross-section of the nozzle ring and thereby alter the flow conditions for the air in the region of the relevant segment. The known apparatus for adjusting the nozzle ring cross-section also is not shown in FIG. 4.

Regulating valves 64–67, which permit a more or less strong throttling of the air streams, are provided in the air supplies 60–63. The air supplied through the air supplies 60–63 is distributed in the manner indicated schematically by the arrows onto the peripheral lengths of the segments 15'*a*–15'*d* of the nozzle ring 15'. In the embodiment according to FIG. 4 the peripheral zones of the grinding plate associated with the individual segments 15'*a*–15'*d* of the nozzle ring 15' can be ventilated different tially (as regards the flow quantities and the flow speeds), which because of the differing material yield in the individual zones facilitates optimization of the pneumatic material discharge and of the coarse material falling downwards against the air stream through the nozzle ring.

Whereas in the embodiment shown in FIGS. 2 and 3 the outer wall parts 20 of the individual segments of the nozzle ring 15 are adjustable by means of powered pneumatic cylinders 22, adjustment by an electrically or hydraulically powered drive, or by means of a spindle actuated by a hand wheel, can be provided within the scope of the invention.

The number of elements of the nozzle ring 15 (which in each case is provided with a separate drive, ventilated and adjustable) is adapted to the particular application. In addition the nozzle ring can contain individual unventilated segments between ventilated and adjustable segments. A construction is for example conceivable having eight ventilated and adjustable segments and four unventilated segments alternating between them.

The air speed in the nozzle ring in the grinding process according to the invention is between about 30 and 60 m/s, and preferably between about 35 and 45 m/s.

The quantity of coarse constituents falling downwards through the nozzle ring and conveyed upwards again by the mechanical elevator is about 25 to 200%, and preferably about 30 to 80%, of the quantity of fresh material delivered to the mill.

Finally, the specific air quantity in the nozzle ring is between about 0.5 and 4 $m^3$/kg, and preferably between about 0.8 and 2 $m^3$/kg of the fresh material delivered to the mill.

The coarse constituents falling downwards through the nozzle ring or the proportions obtained in the second classification and used as a finished product can in case of need be subjected to subsequent drying for which a rising pipe dryer, a spray dryer or a drying drum for example can be used.

The flow conditions in the nozzle ring can be altered not only in the described manner by adjustment of a wall which limits the cross-section of the nozzle ring, by adjustable valves in the air supply lines and by adjustment of conveying blowers, but for example also by partial covering of the nozzle ring or by partial ventilation or partial differential ventilation of the nozzle ring.

It should finally be pointed out that the roller mill used within the scope of the grinding process according to the invention for the simultaneous production of at least two finished products can of course be used in case of need in the conventional manner for producing one single finished product, and the apparatus for influencing the air quantity and air speed in the nozzle ring permits optimum adaptation of the mill to the prevailing conditions.

The following working example serves for further explanation of the invention:

| | |
|---|---|
| Charging capacity: | 125 t/h (dry), 0–50 mm |
| Finished product 1: | 80 t/h at 12% residue on screen 0.09 mm |
| Material in circulation: | approx. 90 t/h at 0–40 mm<br>approx. 45% residue on screen 4.0 mm<br>approx. 95% residue on screen 0.09 mm |
| Grading of the quantity of material in the bucket conveyor produces: | |
| Finished product 2: | approx. 45 t/h at 0–4 mm<br>approx. 90% residue on screen 0.09 mm |
| Coarse material | approx. 45 t/h, 2–40 mm |

-continued

| |
|---|
| (back to the mill): |

The charging capacity referred to is based on dry product. The charging capacity is effectively raised by its water content, depending upon the moistness of the charge.

We claim:

1. A ring mill wherein fresh material is delivered to and comminuted at a grinding zone and desirable finished products of differing fineness classifications are continuously produced from a single grinding process having a grinding plate rotatable about a vertical axis, grinding elements engageable with the plate for comminuting material to be ground, a nozzle ring encircling said plate, and means for establishing an upwardly directed air stream via said nozzle ring of such velocity as to entrain and carry upwardly relatively fine constituents of comminuted material, said mill comprising first and second opposing and upwardly directed walls forming part of said nozzle ring and limiting its internal cross section; means for radially adjusting the position of one of said walls relative to the other to adjust the quantity and velocity of air passing through said nozzle ring to obtain a selected pneumatic preclassification between a first relatively fine narrow range classification of constituents capable of being entrained in said air stream and exhausted from said mill to form a first finished product and a second relatively coarse broad range classification of constituents which cannot be entrained in said air stream and are discharged downwardly through said nozzle ring by gravity; mechanical separating means; conveyor means for delivering all of said relatively coarse constituents of said second classification to said separating means, said separating means being operable to extract from said coarse constituents a proportion of the relatively less coarse constituents of said second classification of substantially uniform size to form a second finished product having constituents coarser than those of said first finished product and finer than the remainder of said coarse constituents; and chute means for continuously delivering fresh material to said mill and returning the remainder of said coarse constituents downward by gravity to said mill for further grinding.

2. A ring mill according to claim 1 wherein said adjusting means is powered.

3. A ring mill according to claim 1 wherein at least one of said walls is composed of a plurality of segments.

4. A ring mill according to claim 3 including means for guiding said segments.

5. A ring mill according to claim 3 wherein said segments are separately adjustable.

6. A ring mill according to claim 3 wherein some of said segments are ventilated and others are not ventilated.

7. A ring mill according to claim 3 including air supply means associated with each of said segments.

8. A ring mill according to claim 7 including means in said air supply means for influencing the air supplied thereby to said ring.

* * * * *